US009592415B2

(12) United States Patent
Tseng et al.

(10) Patent No.: US 9,592,415 B2
(45) Date of Patent: Mar. 14, 2017

(54) AUXILIARY DEVICE FOR MUSCLE STRENGTH TRAINING

(71) Applicant: NATIONAL TAIWAN UNIVERSITY OF SCIENCE AND TECHNOLOGY, Taipei (TW)

(72) Inventors: Tzu-Yu Tseng, Taipei (TW); Chin-Hsing Kuo, Taipei (TW)

(73) Assignee: NATIONAL TAIWAN UNIVERSITY OF SCIENCE & TECHNOLOGY, Taipei (TW)

( * ) Notice: Subject to any disclaimer, the term of this patent is extended or adjusted under 35 U.S.C. 154(b) by 24 days.

(21) Appl. No.: 14/691,687

(22) Filed: Apr. 21, 2015

(65) Prior Publication Data

US 2016/0184622 A1 Jun. 30, 2016

(51) Int. Cl.

| | |
|---|---|
| ***A63B 21/04*** | (2006.01) |
| ***A63B 21/00*** | (2006.01) |
| ***A63B 21/055*** | (2006.01) |

(52) U.S. Cl.

CPC .... *A63B 21/00181* (2013.01); *A63B 21/0552* (2013.01); *A63B 21/4001* (2015.10)

(58) Field of Classification Search

USPC ..... 482/1–148

See application file for complete search history.

(56) References Cited

U.S. PATENT DOCUMENTS 2,660,495 A * 11/1953 Schwalbe ..... A61G 13/009 5/613
2,676,643 A * 4/1954 Miller ..... A61G 5/006 280/47.25
2,696,868 A * 12/1954 Miller ..... A61G 5/006 297/411.36
3,083,512 A * 4/1963 Hilton ..... B65B 51/08 383/71

(Continued)

OTHER PUBLICATIONS

"G-Free: A Gravity-Free Dual-Posture Muscle Training Assistive Device for Lower Limb Paralysis Patient", Thesis published in the Taiwan Innovative Mechanism Design Competition. Published Oct. 2, 2014.

(Continued)

*Primary Examiner* — Stephen Crow

(74) *Attorney, Agent, or Firm* — Amin, Turocy & Watson LLP

(57) ABSTRACT

An auxiliary device for muscle strength training is provided, which includes: a base; a sliding member slidingly coupled to the base; and a connecting-rod mechanism connected to the base and the sliding member in such a way that a positional shift of the sliding member allows the connecting-rod mechanism to rotate relative to the base and change its state. As such, the auxiliary device has first and second configurations to assist patients who are incapable of controlling their muscles by themselves to effectively train specific muscle groups. Further, elastic members are connected to the base and the connecting-rod mechanism and (Continued)

provide elastic potential energies so as to keep the auxiliary device in static equilibrium. The auxiliary device has a simple structure and is easily manufactured at a low cost and applicable for patients with muscle strength lower than grade 3.

10 Claims, 6 Drawing Sheets

(56) References Cited

U.S. PATENT DOCUMENTS 3,142,351 A * 7/1964 Green ..... A61G 5/061
180/8.2
3,411,598 A * 11/1968 Weaver ..... A61G 5/061
180/8.2

OTHER PUBLICATIONS

"Experimental Evaluation of a Gravity-Free Dual-Posture Muscle Training Assistive Device for Lower Limb Paralysis Patient", 175h CSMMT, published Nov. 14, 2014.

* cited by examiner

AUXILIARY DEVICE FOR MUSCLE STRENGTH TRAINING

BACKGROUND OF THE INVENTION

1. Field of the Invention

The present invention relates to auxiliary devices for muscle strength training, and more particularly, to an auxiliary device for improving muscle strength training effect.

2. Description of Related Art

Rehabilitation therapy for patients with limb paralysis, for example, leg paralysis, is an important issue in the field of physical therapy. Limb paralysis may be caused by a cerebral vascular accident (CVA), a complete or incomplete spinal cord injury, a spinal cord vascular disease, a stroke and so on. After assessing patients' individual conditions, physical therapists develop specialized training plans for the patients. Physical training includes such as muscle strength training, standing balance training and weight shift training. Therein, leg muscle strength training is especially important since leg muscle strength is important in supporting the upper body of a patient.

In particular, physical therapists assess patients' muscle strength conditions and provide different levels of muscle strength training. In addition, different auxiliary devices are used according to different levels of muscle strength training. A manual muscle test (MMT) is generally performed to determine the grade of muscle strength. Muscle strength is graded from 0 to 5. At grade 0, no muscle contraction can be seen. At grade 1, a muscle contraction can be seen. At grade 2, a training movement can be achieved only with gravity eliminated. At grade 3, a training movement can be achieved against gravity. At grades 4 and 5, a complete training movement can be achieved against moderate or full resistance.

The auxiliary devices can be classified into active type and passive type. The passive-type auxiliary devices enable passive muscle strength training for patients, and the active-type auxiliary devices allow patients to perform active muscle strength training. Generally, the active-type auxiliary devices are preferred due to a better rehabilitation effect. Further, since the passive-type auxiliary devices are usually driven by electronic devices such as motors, the passive-type auxiliary devices have a high manufacturing cost and are large in size. Therefore, compared with the passive-type auxiliary devices, the active-type auxiliary devices are smaller, lighter and cheaper.

However, the conventional active-type auxiliary devices only provide resistance and are only applicable for patients with muscle strength above grade 3. For patients with muscle strength below grade 3, the passive-type auxiliary devices are required. Further, in order to adjust the resistance value of a conventional active-type auxiliary device, elastic elements of the auxiliary device need to be changed or relative positions of internal components of the auxiliary device needs to be adjusted, thus resulting in considerable inconvenient in use. Furthermore, since the conventional active-type auxiliary devices cannot assist patients who are incapable of controlling their muscles by themselves (i.e., with muscle strength below grade 3) to perform muscle strength training, specific muscle groups of the patients cannot be effectively trained.

Therefore, there is a need to provide an auxiliary device for muscle strength training so as to overcome the above-described drawbacks.

SUMMARY OF THE INVENTION

In view of the above-described drawbacks, the present invention provides an auxiliary device for muscle strength training, which comprises: a base having a sliding rail; a first rod having a sliding slot, a first connecting member pivotally connected to the base and a second connecting member opposite to the first connecting member; a sliding member having a first end slidingly coupled to the sliding rail of the base and a second end opposite to the first end and slidingly received in the sliding slot of the first rod; a second rod having a third connecting member and a fourth connecting member, wherein the third connecting member is pivotally connected to the second connecting member of the first rod; a third rod having a fifth connecting member and a sixth connecting member, wherein the fifth connecting member is pivotally connected to the fourth connecting member of the second rod; a fourth rod having a seventh connecting member and an eighth connecting member, wherein the seventh connecting member is pivotally connected to the sixth connecting member of the third rod; and a fifth rod having a ninth connecting member and a tenth connecting member, wherein the ninth connecting member is pivotally connected between the seventh connecting member and the eighth connecting member of the fourth rod and the tenth connecting member is pivotally connected to the sliding member; wherein when the auxiliary device is in a first configuration, the second end of the sliding member is coaxial with the first connecting member of the first rod so as to allow the first rod to rotate relative to the base. Further, when the auxiliary device is in a second configuration, the second rod rotates relative to the first rod so as to cause the second end of the sliding member to slide in the sliding slot of the first rod and prevent the first rod from moving relative to the base.

In an embodiment, the auxiliary device further comprises a first elastic member connected between the base and the first rod. When the auxiliary device is in the first configuration, the first elastic member constantly provides an elastic potential energy to keep the auxiliary device in static equilibrium.

Therefore, the auxiliary device of the present invention is simple in construction. To adjust the resistance value of the auxiliary device, the present invention does not need to change elastic members or perform complicated operations to adjust relative positions of internal components of the auxiliary device as in the prior art, thereby improving the convenience in use of the active-type auxiliary device.

Further, the auxiliary device of the present invention has one degree of freedom due to restriction of relative movements of the rods in the connecting-rod mechanism. Furthermore, an elastic member connected to the connecting-rod mechanism provides an elastic potential energy to support a total gravitational potential energy of the auxiliary device and a human body connected to the auxiliary device so as to reach static equilibrium. As such, the auxiliary device of the present invention is applicable for patients with muscle strength lower than grade 3 so as to replace the conventional passive-type auxiliary device and hence reduce the rehabilitation cost. Also, the auxiliary device of the present invention assists patients who are incapable of controlling their muscles by themselves to effectively train specific muscle groups and prevent involuntary muscle contractions.

DETAILED DESCRIPTION OF PREFERRED EMBODIMENTS

The following illustrative embodiments are provided to illustrate the disclosure of the present invention, these and other advantages and effects can be apparent to those in the art after reading this specification.

It should be noted that all the drawings are not intended to limit the present invention. Various modifications and variations can be made without departing from the spirit of the present invention. Further, terms such as "on", "a" etc. are merely for illustrative purposes and should not be construed to limit the scope of the present invention.

Figure 1:
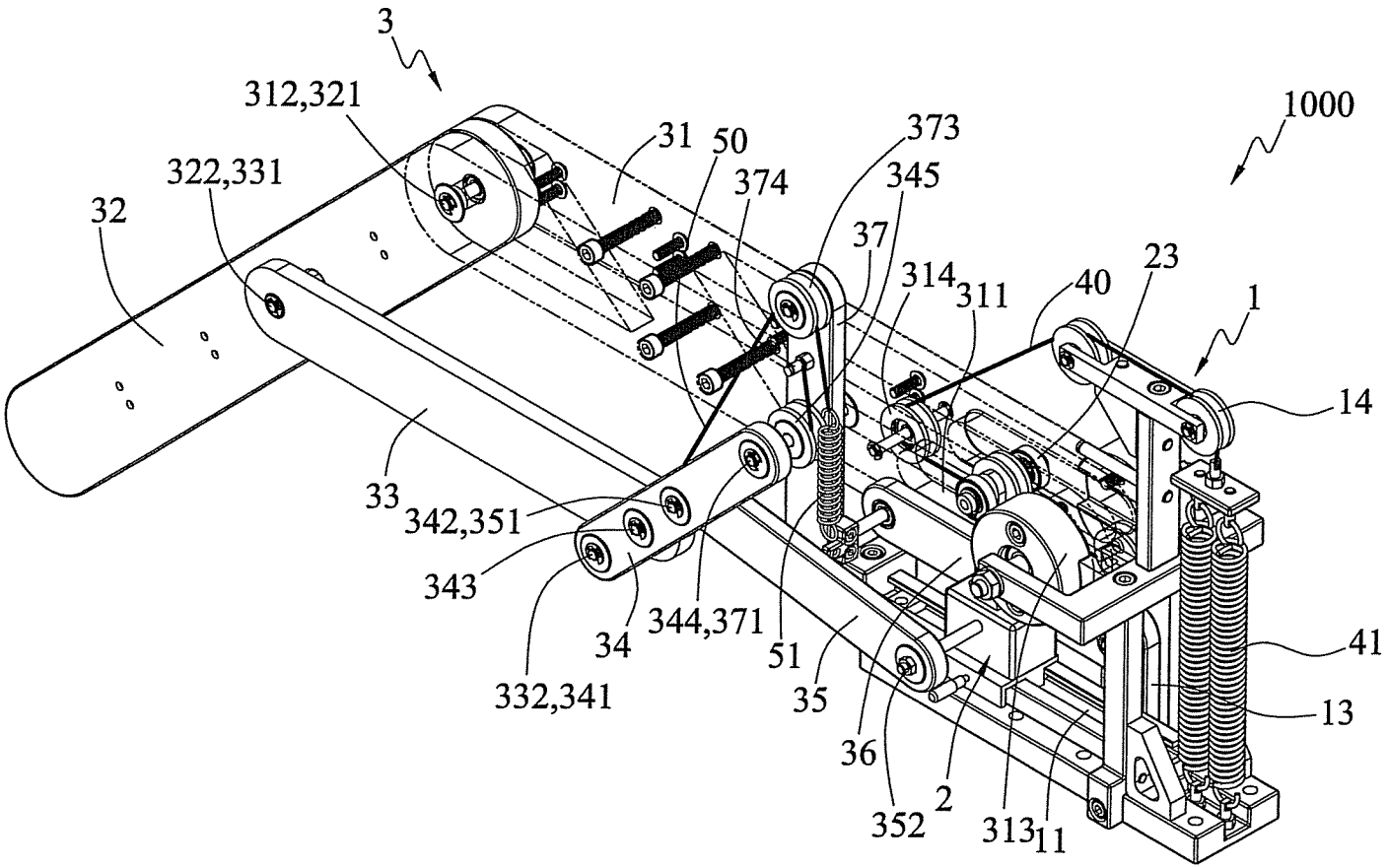
FIG. 1 is a schematic oblique front view of an auxiliary device for muscle strength training according to the present invention.
Figure 2:
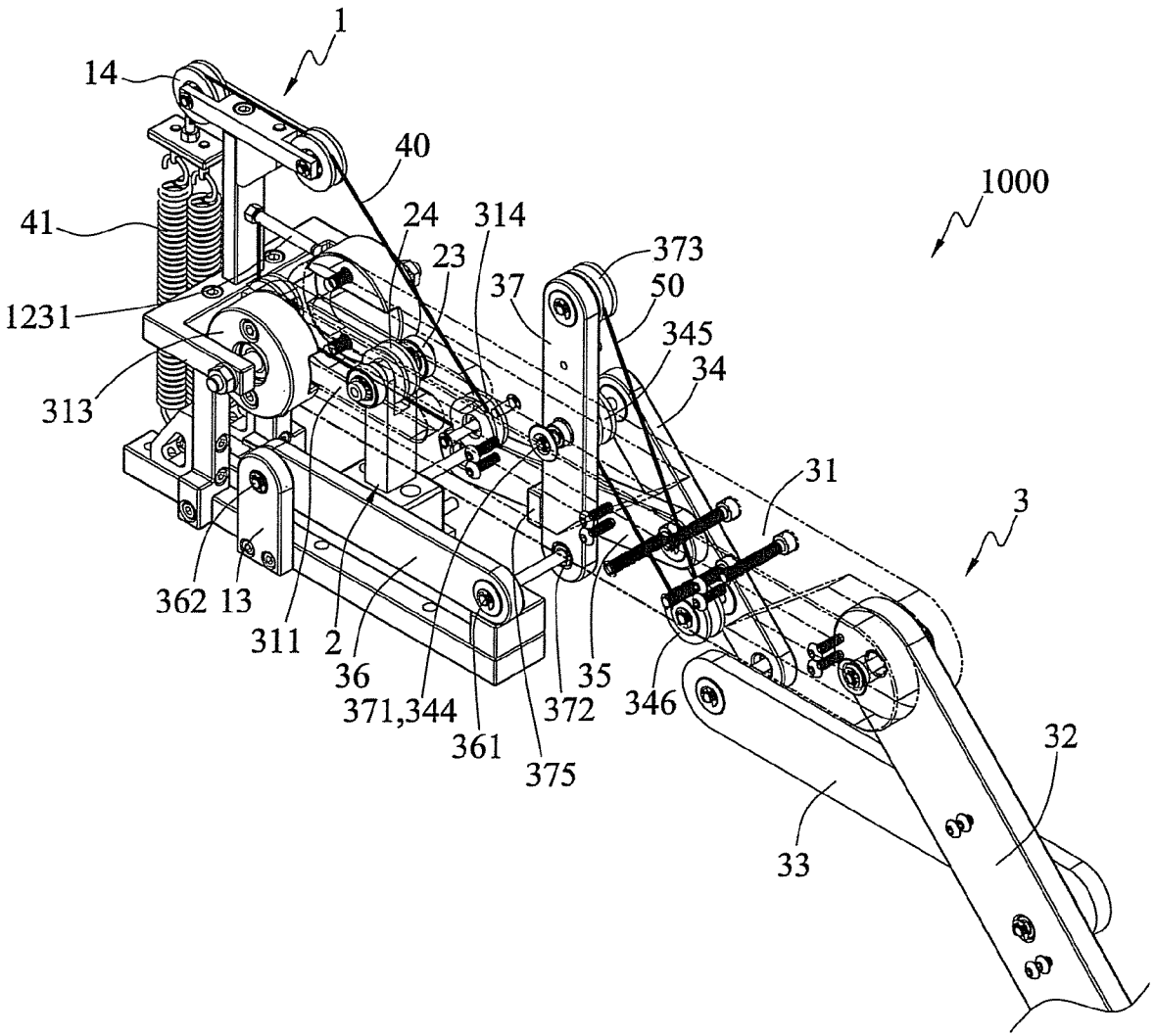
FIG. 2 is a schematic oblique rear view of the auxiliary device of the present invention.
Figure 3:
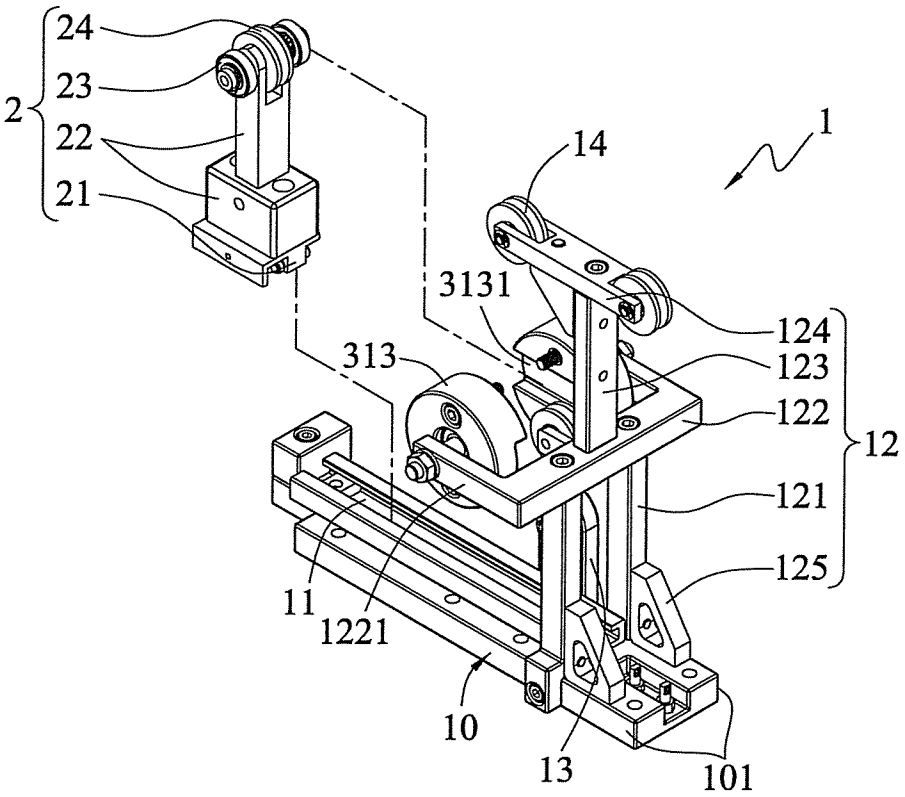
FIG. 3 is a schematic partial assembly view of the auxiliary device of the present invention.

FIG. 1 is a schematic oblique front view of an auxiliary device 1000 for muscle strength training according to the present invention, FIG. 2 is a schematic oblique rear view of the auxiliary device 1000 of the present invention and FIG. 3 is a schematic partial assembly view of the auxiliary device 1000 of the present invention.

Referring to FIGS. 1 to 3, the auxiliary device 1000 has a base 1, a sliding member 2 slidingly coupled to the base 1, a connecting-rod mechanism 3 pivotally coupled to the base 1 and the sliding member 2, and first and second elastic members (not denoted with a reference numeral).

Referring to FIG. 3, the base 1 has a base board 10 having a side 101, a sliding rail 11, a support frame 12, a side board 13 fixed to the side 101 of the base board 10, and a plurality of first idle wheels 14.

The support frame 12 has a first column 121 fixed on the base board 10, a transverse board 122 fixed on the first column 121, a second column 123 fixed on the transverse board 122, an extension board 124 spaced from the transverse board 122 and fixed on the second column 123, and a triangular fixing board 125 having one side fixed to the base board 10 and another side fixed to the first column 121 so as to improve the bonding effect of the support frame 12 on the base board 10. The transverse board 122 has a protruding portion 1221 spaced from the base board 10 and extending in a long axis direction of the base board 10. As such, when viewed from top, the transverse board 122 has a U-shape. The first idle wheels 14 are pivotally disposed on two ends of the extension board 124 and positioned between the protruding portion 1221 of the transverse board 122.

The sliding member 2 has a connecting portion 22, a sliding block 21 fixed to one end of the connecting portion 22 and slidingly disposed on the sliding rail 11 of the base 1, a first wheel 23 and a second idle wheel 24 pivotally disposed on the other end of the connecting portion 22. As such, the sliding member 2 has a first end having the sliding block 21 and a second end having the first wheel 23.

Referring to FIGS. 1 and 2, the connecting-rod mechanism 3 has a first rod 31, a second rod 32, a third rod 33, a fourth rod 34 and a fifth rod 35.

The first rod 31 has a sliding slot 311 that allows the first wheel 23 of the sliding member 2 to be slidingly disposed thereon, a first connecting member and an opposite second connecting member 312 at two ends of the first rod 31, a second wheel 313 pivotally disposed on the protruding portion 1221 of the base 1, and a third idle wheel 314 disposed inside the first rod 31. The first rod 31 is rotatable relative to the base 1 through the second wheel 313. The second rod 32 has a third connecting member 321 at one end thereof and a fourth connecting member 322 at the middle thereof. The third connecting member 321 of the second rod 32 is pivotally connected to the second connecting member 312 of the first rod 31. The third rod 33 has a fifth connecting member 331 and a sixth connecting member 332 at two ends thereof. The fifth connecting member 331 of the third rod 33 is pivotally connected to the fourth connecting member 322 of the second rod 32. The fourth rod 34 has a seventh connecting member 341 and an eighth connecting member 344 at two ends thereof, a first connecting portion 342 between the seventh connecting member 341 and the eighth connecting member 344, and a second connecting portion 343 between the seventh connecting member 341 and the first connecting portion 342. A fourth idle wheel 345 is disposed on the eighth connecting member 344 and a fifth idle wheel 346 is disposed on the second connecting portion 343, as shown in FIG. 2. The fifth rod 35 has a ninth connecting member 351 and a tenth connecting member 352 at two ends thereof. The ninth connecting member 351 of the fifth rod 35 is pivotally connected to the first connecting portion 342 of the fourth rod 34, and the tenth connecting member 352 of the fifth rod 35 is pivotally connected to the connecting portion 22 of the sliding member 2 as shown in FIG. 3. In the present embodiment, the first rod 31, the second rod 32, the third rod 33 and the fourth rod 34 constitute a parallel four-connecting-rod mechanism. But it should be noted that the parallel four-connecting-rod mechanism can be varied according to the practical need and the present invention is not limited thereto.

Figure 5:
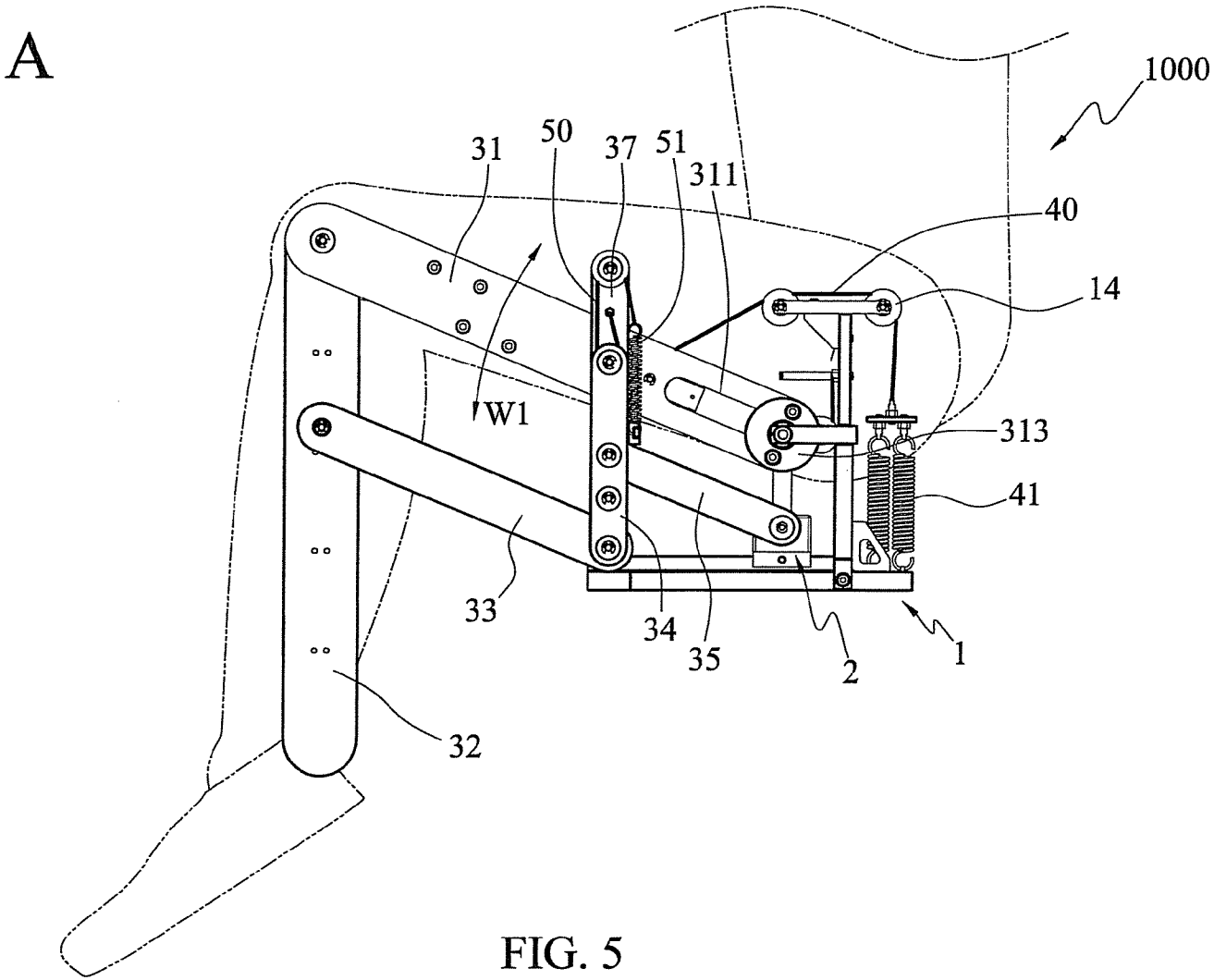
FIG. 5 is a schematic view showing a first configuration of the auxiliary device of the present invention.
Figure 6:
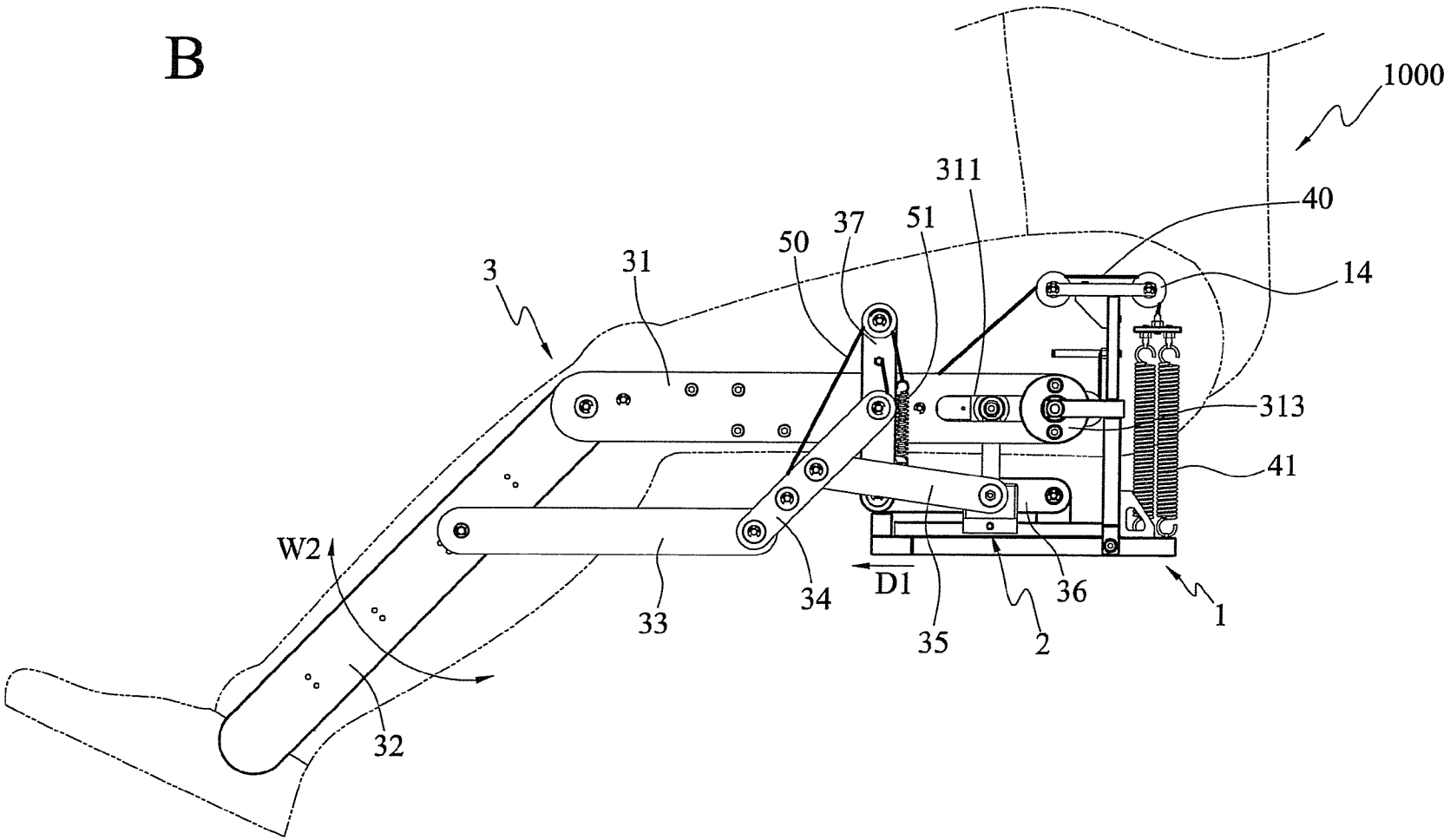
FIG. 6 is a schematic view showing a second configuration of the auxiliary device of the present invention.

Since the first end of the sliding member 2 is slidingly disposed on the sliding rail 11 of the base 1 and the second end of the sliding member 2 is slidingly disposed on the sliding slot 311 of the first rod 31, the connecting relationship between the base 1 and the connecting-rod mechanism 3 can be changed through the sliding member 2 so as to achieve a reconfigurable mechanism. That is, the present invention allows the auxiliary device 1000 to have a first configuration A and a second configuration B, each of which is used for training a single movement, as shown in FIGS. 5 and 6. Further, the auxiliary device 1000 has one degree of freedom due to restriction of relative movements of the above-described components.

Furthermore, the present invention combines the reconfigurable mechanism with a static balancing mechanism design and uses an energy method for the design. In the present invention, elastic potential energies are generated by elastic members to compensate varied gravitational potential energy during operation of the mechanism, thereby keeping the total potential energy of the mechanism in any configuration at a certain value and hence achieving system balance. Therefore, the present invention uses elastic members to provide elastic potential energies and support a gravitational potential energy of the auxiliary device 1000 and a body, for example, a person, connected to the auxiliary device 1000 to thereby achieve static equilibrium. As such, elastic constants of the elastic members that are required for achieving static equilibrium of the system (i.e., the auxiliary device and the person connected thereto) are calculated based on the rule of static equilibrium, the. In addition, the present invention provides additional rods that are connected to the elastic members.

The connecting-rod mechanism 3 further has a sixth rod 36 and a seventh rod 37. The sixth rod 36 has an eleventh connecting member 362 and a twelfth connecting member 361 at two ends thereof, as shown in FIG. 2. The eleventh connecting member 362 of the sixth rod 36 is pivotally connected to the side board 13 of the base 1. The seventh rod 37 has a thirteenth connecting member 371 at the middle thereof, a fourteenth connecting member 372 (shown in FIG. 2) at one end thereof, a sixth idle wheel 373 on the other end thereof and spaced from the fourteenth connecting member 372, a fixing column 374 between the sixth idle wheel 373 and the thirteenth connecting member 371, and a block 375 (shown in FIG. 2) between the thirteenth connecting member 371 and the fourteenth connecting member 372. The thirteenth connecting member 371 of the seventh rod 37 is pivotally connected to the eighth connecting member 344 of the fourth rod 34 and between the first connecting member and the second connecting member 312 of the first rod 31. The fourteenth connecting member 372 of the seventh rod 37 is pivotally connected to the twelfth connecting member 362 of the sixth rod 36, as shown in FIG. 2.

Through the above-described additional rods, a first elastic member and a second elastic member are disposed to achieve static equilibrium of the system.

The first elastic member has a first string 40 and a first spring 41. The first string 40 slides against the first idle wheel 14 of the base 1, the second idle wheel 24 of the sliding member 2 (shown in FIG. 2) and the third idle wheel 314 of the first rod 31. One end of the first string 40 is fixed to a projecting portion 1231 of the second column 123 (shown in FIG. 2), and the other end of the first string 40 is fixed to one end of the first spring 41. The other end of the first spring 41 is fixed to the base 1. As such, when the first rod 31 has an angular displacement, the first spring 41 is pulled by the first string 40 to deform. When the extension of the first spring 41 changes, an elastic potential energy is generated or changed to support the gravitational potential energy of the auxiliary device 1000 and the connected body.

The second elastic member has a second string 50 and a second spring 51. The second string 50 slides against the fourth idle wheel 345 and the fifth idle wheel 346 of the fourth rod 34 (shown in FIG. 2) and the sixth idle wheel 373 of the seventh rod 37. One end of the second string 50 is fixed to the fixing column 374 of the seventh rod 37 and the other end of the second string 50 is fixed to one end of the second spring 51. The other end of the second spring 51 is fixed to the block 375 of the seventh rod 37. As such, when the second rod 32 has an angular displacement, the second spring 51 is pulled by the second string 50 to deform. When the extension of the second spring 51 changes, an elastic potential energy is generated or changed to support the gravitational potential energy of the auxiliary device 1000 and the connected body.

In the present embodiment, the first spring 41 and the second spring 51 are, but not limited to, extension springs.

Figure 4:
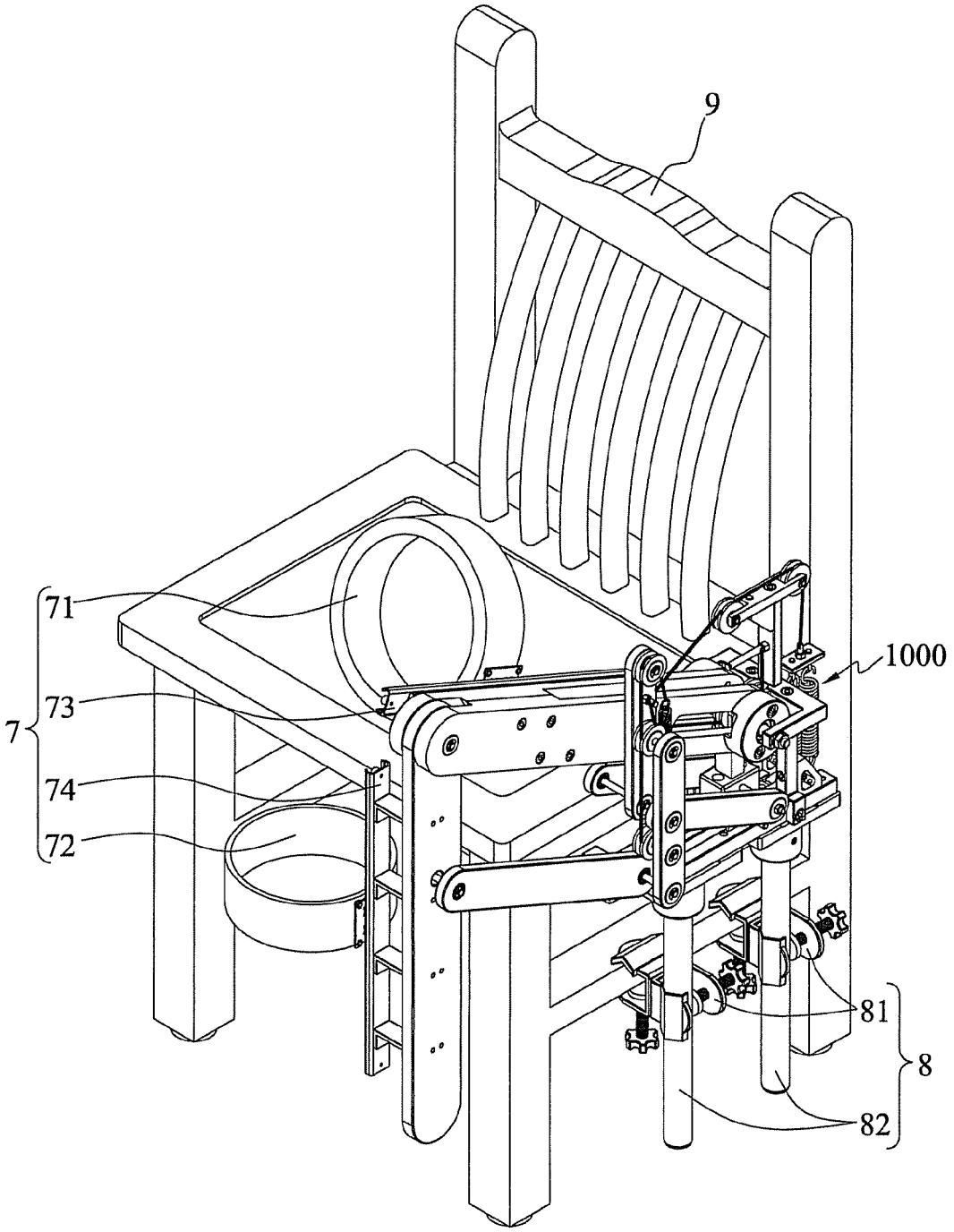
FIG. 4 is a schematic view showing bonding of the auxiliary device of the present invention to an object.

Referring to FIG. 4, the auxiliary device 1000 is further fixed to an object 9 that allows a person to abut against. In the present embodiment, the object 9 is a chair. In particular, the auxiliary device 1000 further has a locking member 8 fixed on the object 9. The locking member 8 has an extension column 82 fixed on the auxiliary device 1000 and a securing means 81 connecting the extension column 81 and the object 9. The position of the auxiliary device 1000 relative to the object 9 can be adjusted through the securing means 81 so as to allow the auxiliary device 1000 and the hip joint of the person to be coaxial. The auxiliary device 1000 further has a holding member 7 to be connected with the person. The holding member 7 has a first straight board 73 fixed to the first rod 31, a second straight board 74 fixed to the second rod 32, a first holding ring 71 locked to the first straight board 73, and a second holding ring 72 locked to the second straight board 74. As such, when the person abuts against the object 9, a portion of his body is held by the first holding ring 71 and the second holding ring 72. Therefore, when the person moves the portion of his body, there is a relative movement between the components of the auxiliary device 1000. Therein, the position of the first holding ring 71 on the first straight board 73 and the position of the second holding ring 72 on the second straight board 74 are adjusted so as to change the length of force arm. Therefore, by changing the bonding position of the body portion, the resistance value can be changed to achieve different muscle strength trainings at different levels.

Referring to FIGS. 5 and 6, as an example, the upper leg of the person is fixed to the first rod 31 through the first holding ring 71 and the lower leg of the person is fixed to the second rod 32 through the second holding ring 72. The first configuration A is defined by the upper leg movement (i.e., hip flexion/extension) and the second configuration B is defined by the lower leg movement (i.e., knee flexion/extension). In the first configuration A, the first spring 41 provides an elastic potential energy to support the gravitational potential energy of the auxiliary device 1000 and the leg so as to keep the auxiliary device 1000 in static equilibrium. In the second configuration B, the second spring 51 provides an elastic potential energy to support the gravitational potential energy of the auxiliary device 1000 and the leg so as to keep the auxiliary device 1000 in static equilibrium.

In particular, in the first configuration A, the first wheel 23 of the sliding member 2 is positioned on one end of the sliding slot 311 and coaxial with the second wheel 313. As such, the first rod 31 is not limited by the height of the sliding member 2 and capable of making an angular displacement W1 relative to the base 1. Also, the sliding slot 311 is displaced by an angle due to the rotation of the first rod 31. Hence, the sliding member 2 cannot move in a first direction D1, and there is no relative movement between the sliding member 2 and the base 1. Further, the relative position of the third, fourth and fifth rods 33, 34. 35 is fixed by the sliding member 2. That is, there is no relative movement between the third, fourth and fifth rods 33, 34. 35. As such, there is no angular displacement occurring to the second rod 32. Therefore, the auxiliary device 1000 is kept in the first configuration A. The first angular displacement W1 of the first rod 31 causes the first string 40 to pull the first spring 41. When the extension of the first spring 41 changes, an elastic potential energy is generated or changed to support the gravitational potential energy of the auxiliary device 1000 and the leg, thus achieving a muscle strength training effect on the upper leg.

In addition, in the first configuration A, the fourth rod 34 and the seventh rod 37 are collinear with the second spring 51 and there is no significant deformation occurring to the second spring 51. Therefore, in the first configuration A, the extension of the second spring 51 will not be changed by the angular displacement W1 of the first rod 31, and the second spring 51 does not influence the static equilibrium of the system.

In the second configuration B, the first rod 31 is substantially at a horizontal position relative to the base 1. The sliding member 2 is slidable along the sliding slot 311 in the first direction D1, and the first rod 31 is limited by the height of the sliding member 2 and kept a fixed distance from the base 1. As such, there is no significant relative rotation between the first rod 31 and the base 1, and sliding of the sliding member 2 along the sliding slot 311 causes the second rod 32 to make a second angular displacement W2 relative to the first rod 31. Therefore, the auxiliary device 1000 is kept in the second configuration B. The second angular displacement W2 of the second rod 32 causes the second string 50 to pull the second spring 51. When the extension of the second spring 51 changes, an elastic potential energy is generated or changed to support the gravitational potential energy of the auxiliary device 1000 and the leg, thus achieving a muscle strength training effect on the lower leg.

In addition, in the second configuration B, the first rod 31 is substantially at a horizontal position relative to the base 1 and there is no significant movement therebetween. Therefore, in the second configuration B, the extension of the first spring 41 will not be changed by the angular displacement W2 of the second rod 32, and the first spring 41 does not influence the static equilibrium of the system.

Therefore, the present invention provides an active-type auxiliary device for muscle strength training based on a static balancing mechanism design in combination with a reconfigurable mechanism. The auxiliary device has one degree of freedom due to restriction of relative movements of the rods in the connecting-rod mechanism. Furthermore, a spring connected to the connecting-rod mechanism provides an elastic potential energy to support a total gravitational potential energy of the auxiliary device and a human body connected to the auxiliary device so as to reach static equilibrium. As such, the auxiliary device of the present invention is applicable for patients with muscle strength lower than grade 3 so as to replace the conventional passive-type auxiliary device and hence reduce the rehabilitation cost. Also, the auxiliary device of the present invention assists patients who are incapable of controlling their muscles by themselves to effectively train specific muscle groups and prevent involuntary muscle contractions.

Further, the upper leg and the lower leg of a person are indirectly fixed to the first rod and the fourth rod of the auxiliary device, respectively. In the first configuration, the first rod is rotatable relative to the base and there is no relative movement between the second rod and the first rod, thus achieving a muscle strength training effect on the upper leg. Further, in the second configuration, there is no relative movement between the first rod and the base and the second rod is rotatable relative to the first rod, thus achieving a muscle strength training effect on the lower leg.

Furthermore, the active-type auxiliary device of the present invention is simple in construction. To adjust the resistance value of the auxiliary device, the present invention does not need to change elastic members or perform complicated operations to adjust relative positions of internal components of the auxiliary device as in the prior art, thereby improving the convenience in use of the active-type auxiliary device.

The above-described descriptions of the detailed embodiments are only to illustrate the preferred implementation according to the present invention, and it is not to limit the scope of the present invention. Accordingly, all modifications and variations completed by those with ordinary skill in the art should fall within the scope of present invention defined by the appended claims.

What is claimed is:

1. An auxiliary device for muscle strength training, comprising:

a base having a sliding rail;

a first rod having a sliding slot, a first connecting member pivotally connected to the base and a second connecting member opposite to the first connecting member;

a sliding member having a first end slidingly coupled to the sliding rail of the base and a second end opposite to the first end and slidingly received in the sliding slot of the first rod;

a second rod having a third connecting member and a fourth connecting member, wherein the third connecting member is pivotally connected to the second connecting member of the first rod;

a third rod having a fifth connecting member and a sixth connecting member, wherein the fifth connecting member is pivotally connected to the fourth connecting member of the second rod;

a fourth rod having a seventh connecting member and an eighth connecting member, wherein the seventh connecting member is pivotally connected to the sixth connecting member of the third rod;

a fifth rod having a ninth connecting member and a tenth connecting member, wherein the ninth connecting member is pivotally connected between the seventh connecting member and the eighth connecting member of the fourth rod and the tenth connecting member is pivotally connected to the sliding member; and a holding member for holding an external body to be assisted by the auxiliary device for muscle strength training;

wherein when the auxiliary device is in a first configuration, the second end of the sliding member is coaxial with the first connecting member of the first rod so as to allow the first rod to rotate relative to the base.

2. The device of claim 1, wherein when the auxiliary device is in a second configuration, the second rod rotates relative to the first rod so as to cause the second end of the sliding member to slide in the sliding slot of the first rod.

3. The device of claim 1, further comprising a first elastic member connected between the base and the first rod, wherein when the auxiliary device is in the first configuration, the first elastic member constantly provides an elastic potential energy to keep the auxiliary device in static equilibrium.

4. The device of claim 2, further comprising a sixth rod having an eleventh connecting member and a twelfth connecting member and a seventh rod having a thirteenth connecting member and a fourteenth connecting member, wherein the eleventh connecting member of the sixth rod is pivotally connected to the base, the thirteenth connecting member of the seventh rod is pivotally connected to the eighth connecting member of the fourth rod and between the first connecting member and the second connecting member of the first rod, the fourteenth connecting member of the seventh rod is pivotally connected to the twelfth connecting member of the sixth rod, wherein when the auxiliary device is in the first configuration, the fourth rod and the seventh rod are collinear, and when the auxiliary device is in the second configuration, the seventh rod and the sixth rod do not rotate relative to the base.

5. The device of claim 4, further comprising a second elastic member connected between the fourth rod and the seventh rod, wherein when the auxiliary device is in the first configuration, the fourth rod and the seventh rod are collinear with the second elastic member, and when the auxiliary device is in the second configuration, the second elastic member constantly provides an elastic potential energy to keep the auxiliary device in static equilibrium.

6. The device of claim 2, wherein the sliding member further has a sliding block slidingly disposed on the sliding rail and a first wheel slidingly disposed on the sliding slot, wherein when the auxiliary device is in the second configuration, the first wheel slides in the sliding slot to prevent the first rod from rotating relative to the base.

7. The device of claim 1, wherein the sliding member further has a first wheel slidingly disposed on the sliding slot and the first rod further has a second wheel pivotally disposed on the base, wherein when the auxiliary device is in the first configuration, the first wheel and the second wheel rotate coaxially and the second wheel causes the first rod to rotate relative to the base.

8. The device of claim 7, wherein the second wheel has a recessed slot collinear with the sliding slot, the first wheel being received in the recessed slot and coaxial with the second wheel.

9. The device of claim 1, wherein the eighth connecting member of the fourth rod is pivotally connected to the first rod, the first, second, third and fourth rods to constitute a parallel four-connecting-rod mechanism.

10. The device of claim 1, further comprising a locking member for locking the auxiliary device to an external object.

* * * * *